US006053702A

United States Patent [19]

Sears

[11] Patent Number: 6,053,702

[45] Date of Patent: Apr. 25, 2000

[54] PORTABLE WATER PUMP HAVING A PRESSURE CONTROL CIRCUIT WITH A BYPASS CONDUIT

[76] Inventor: Samuel D. Sears, P.O. Box 2002, Henderson, Ky. 42420

[21] Appl. No.: 09/115,428

[22] Filed: Jul. 15, 1998

[51] Int. Cl.[7] ..... F04B 49/035

[52] U.S. Cl. ..... 417/26; 417/43; 417/62; 417/307; 417/366; 417/426

[58] Field of Search ..... 417/26, 43, 44.2, 417/62, 308, 309, 366, 426

[56] References Cited

U.S. PATENT DOCUMENTS

| | | | |
|---|---|---|---|
| 2,280,626 | 4/1942 | Carpenter | 417/199.1 |
| 3,299,815 | 1/1967 | Thaw | 103/5 |
| 3,584,974 | 6/1971 | Nicastro | 417/202 |
| 3,617,151 | 11/1971 | Scroggins | 417/18 |
| 3,707,336 | 12/1972 | Theis, Jr. et al. | 416/186 R |
| 3,726,618 | 4/1973 | Dicmas | 415/11 |
| 3,867,070 | 2/1975 | Sloan | 417/34 |
| 4,057,371 | 11/1977 | Pilarczyk | 417/409 |
| 4,082,482 | 4/1978 | Erickson et al. | 417/408 |
| 4,091,644 | 5/1978 | Bochan | 68/18 |
| 4,156,578 | 5/1979 | Agar et al. | 415/1 |
| 4,158,525 | 6/1979 | Kawase et al. | 415/1 |
| 4,248,194 | 2/1981 | Drutchas et al. | 123/357 |
| 4,311,395 | 1/1982 | Douthitt et al. | 366/27 |
| 4,448,574 | 5/1984 | Shimizu | 417/488 |
| 4,492,514 | 1/1985 | Dron | 415/1 |
| 4,526,513 | 7/1985 | Bogel | 417/56 |
| 4,780,050 | 10/1988 | Caine et al. | 415/52 |
| 5,131,818 | 7/1992 | Wittkop et al. | 417/473 |
| 5,599,164 | 2/1997 | Murray | 415/144 |
| 5,839,205 | 11/1998 | Hung | 34/97 |
| 5,930,852 | 8/1999 | Gravatt et al. | 4/541.1 |

*Primary Examiner*—Charles G. Freay
*Assistant Examiner*—Robert Z. Evora
*Attorney, Agent, or Firm*—Edward H. Renner

[57] ABSTRACT

A booster water pump for increasing source water pressure to a high water pressure for industrial use, has an elongated tubular hollow cylinder having both ends closed with a cylinder inlet port in one end, and a cylinder outlet port to permit the cylinder to be filled with source water. The pump has a submersible motor and hydroturbine pumping unit so articulated that turbine impellers are adjacent the motor and a turbine outlet is away from the motor, the motor-pump unit fitting in the tubular cylinder. The water passageway is annular and the turbine outlet is attached inside the cylinder to the cylinder outlet port. The pump is highly portable and effective to provide high pressure water to remote locations from low pressure sources.

8 Claims, 4 Drawing Sheets

PORTABLE WATER PUMP HAVING A PRESSURE CONTROL CIRCUIT WITH A BYPASS CONDUIT

FIELD OF THE INVENTION

This invention, in one of its aspects, relates to a high pressure water pump. In a another of its aspects the invention pertains to a booster pump, that is, a pump adapted to increase water pressure from that supplied by normal water lines or systems to a high pressure required for industrial uses. Even more specifically the invention provides a self priming pump.

BACKGROUND OF THE INVENTION

High pressure water pumps can be used for a variety of purposes. For example in the coal mining industry pumps are employed to provide high pressure water, boosted water pressures, to spray the coal when cutting to keep dust to a minimum and to cool equipment. In subterranean coal mining it is desirable to use pure water rather than environmentally hazardous substances. High pressure pumps are in use for high pressure jet cleaning, for instance in the cleaning of sewers, as well as in certain excavations, in golf course pumping systems, and in the pumping of emulsions.

As pointed out in U.S. Pat. No. 3,867,070 high pressure pumps have had several shortcomings, one being the difficulty in priming such pumps. In addition, as described in U.S. Pat. No. 4,448,574 and U.S. Pat. No. 5,131,818, high pressure pumps which utilize pistons and cylinder arrangements pose friction and lubrication problems. The booster pump herein is not subject to the priming disadvantage or the friction problem.

A submersible hydroturbine booster pump is the described in U.S. Pat. No. 3,584,974. However this pump, as are others such as U.S. Pat. No. 4,780,050, is adapted for aircraft fuel. Other turbine pumps are the subject of U.S. Pat. No. 4,082,482, U.S. Pat. No. 4,091,644, U.S. Pat. No. 4,158,525, U.S. Pat. No. 4,492,514, and U.S. Pat. No. 4,780,050. These relate generally to pumps for water and oil wells. Patents such as U.S. Pat. No. 3,726,618 provide self priming pumps for unloading tankers and the like. These, then do not possess the elements utilized in the booster pump herein.

SUMMARY OF THE INVENTION

A booster water pump is provided herein which increases water pressure from whatever source to a high water pressure stream which can be utilized for industrial purposes. In general the booster pump is in the form of a torpedo-like elongated tubular hollow cylinder. Both ends of the cylinder are closed except for an inlet port in one end, and a flange in its opposite end. The flange has a cylinder outlet port in it which renders the cylinder capable of being filled with water from the source. Inside the closed cylinder is a submersible motor and hydroturbine pumping unit. This unit is articulated so that impellers of the turbine are adjacent the motor, and the turbine outlet is away from the motor. The motor-pump unit is configured for insertion in the tubular cylinder, and it fits in the cylinder or barrel with an annular passageway around it which can be filled with water as will be described. The pump unit is suspended within the cylinder with the turbine outlet attached to the cylinder outlet port in the flange. Outside the cylinder a water inlet pipe is attached to the cylinder inlet port, and a water outlet pipe is attached to the cylinder outlet port. An automatic bypass line is employed having its first end connected to and opening into the water inlet pipe. Its second end is connected to and opens into the water outlet pipe. To maintain an operating pressure, means for controlling the pressure are included. This control means is in the form of a bypass relief valve configured with an inlet communicating with the water outlet pipe and an outlet communicating with the automatic bypass line. A means for connecting a water line from the water source to the water inlet pipe is provided, and for starting the pump, a means in the form of a flow switch are used. The flow switch is incorporated in the water inlet pipe and it starts the pump in response to flow through the water inlet pipe. A predetermined flow rate through the water outlet pipe is maintained. For maintaining this flow rate the flow switch is used in combination with a pressure switch. The pressure switch is adapted to turn on the pump when discharge line pressure drops below the operating pressure. The pressure switch can be disposed in either the bypass line, or in the outlet pipe downstream from the bypass relief valve.

DETAILED DESCRIPTION OF THE INVENTION

As previously pointed out, a great many pumps are available but high pressure pumps appear to be employed in fuel tanks or disposed vertically in wells. In addition high pressure pumps present priming problems. The patent art, then, encompasses mostly improvements. The improvement herein can best be described by referring to drawings, now to be briefly characterized.

DESCRIPTION OF A PREFERRED EMBODIMENT

Figure 1:
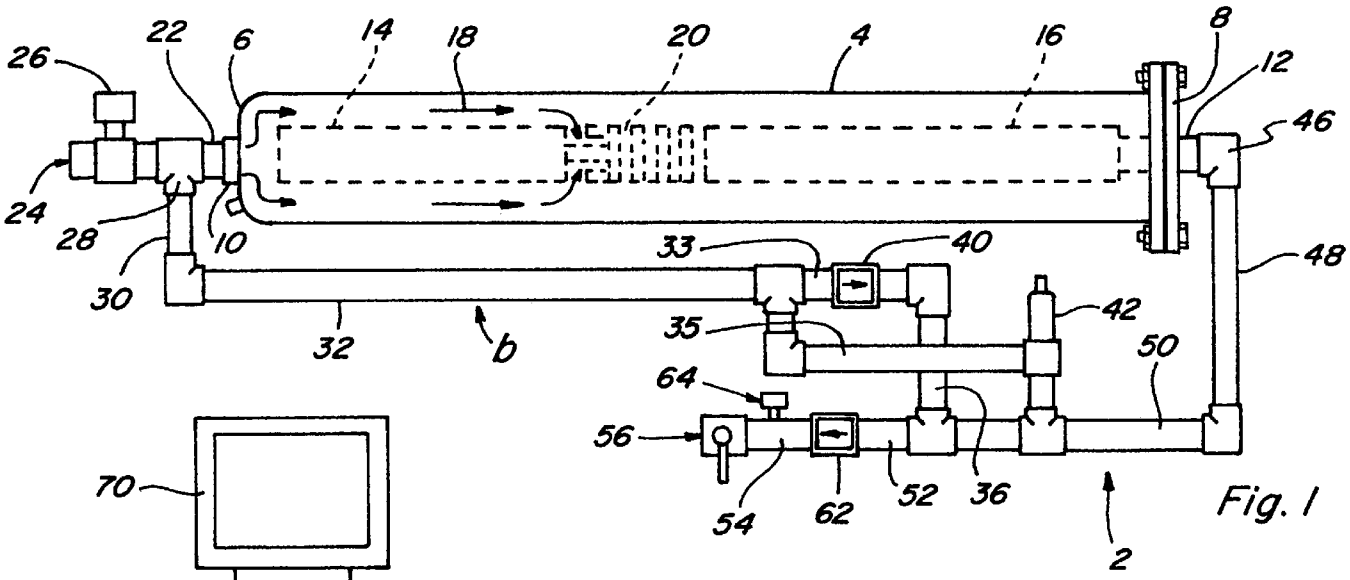
FIG. 1 is a diagrammatic representation of one booster pump embodiment of the invention.

Shown in FIG. 1 is a booster pump 2 illustrating its component parts. The pump is essentially a torpedo-shaped or elongated horizontal cylinder 4 having attached thereto the necessary tubing for the pump operation. It can be seen that cylinder 4 has a closed end 6 and an accessible end which is closed by a flange 8. Closed end 6 is provided with an inlet port 10, and flanged end 8 is provided with an outlet port 12. Inside cylinder 4 an articulated motor 14 and a hydroturbine pump 16 driven thereby are mounted. These are not visible when looking at the finished booster pump. The motor and turbopump are well known and hence not shown in detail except that turbopump inlets 18 and turbine impellers 20 are illustrated. It is to be noted that the motor-turbopump combination is mounted in cylinder 4 with the pump outlet attached to cylinder outlet port 12 so that water leaving the turbopump is forced into the outlet in flange 8 as will be described. The motor-pump combination is suspended so that there is a water chamber 21 surrounding it.

For a description of the pipes and instruments attached to cylinder 4, it is best to begin with inlet end 6 of the booster pump. Attached to exterior inlet port 10 is tubing 22. the open end 24 of this pipe is adapted with a coupling for attachment to a hose leading from a water supply provided by the city or industry concerned. It is the pressure from this hose which is to be increased by the booster pump herein. Just downstream from coupling 24 is a commercially available flow switch 26. This flow switch performs two functions. First, it starts the pump when it is activated by the flow of water therethrough, and it will stay open as long as there is a flow of fluid through it. Second, it will keep the booster pump running and maintain the desired flow when the flow has been started by the pressure switch in response to low pressure.

Down stream from flow switch 26 is a pipe T-joint 28 which permits flow through an automatic bypass b, formed by pipes 30, 32, 33, 35 and 36. Included in bypass b is check valve 40 and pressure relief valve 42. The bypass and valves 40 and 42 will be described in conjunction with the operation of the booster pump.

Referring now to the outlet end at port 8 of cylinder 4, it will be seen that a water outlet pipe 46 is attached outside the cylinder to the exterior cylinder outlet port 12. Through pipe outlet sections 48, 50, 52 and 54 the outlet conduit leads to outlet coupling 56. Included in the outlet conduit are pressure relief valve 42, check valve 62, and pressure switch 64, illustrated in detail in FIGS. 2 and 3.

With the components of the booster pump in mind the operation of the high pressure pump will now be described. One of the features of this invention is that the booster pump provided is self priming. This is accomplished by completely surrounding the pump inside cylinder 4 with water. When the turbopump within the booster pump is off water will fill chamber 21 and will flow through the automatic bypass b through check valves 40 and 62 and then out port 56.

Once chamber 21 is filled the turbopump is primed for use. Motor 14 can then be activated by flow switch 26. When motor 14 is started it will turn turbine impellers 20 via a steel splined coupling between the motor output shaft and the pump input shaft. As the speed of motor 14 increases water is drawn into turbopump inlets 18 and is forced through the internal pump body by the rotating impellers. As water is forced by each impeller 20 the pressure is increased each time until it is forced out of the internal pump outlet 12 under maximum pressure. This pressurized water is then discharged through outlet lines 48, 50, 52, and 54 to outlet 56. The inlet water pressure at coupling 24 is normally between 50 psi and 150 psi. The discharge pressure at outlet 56 is generally between 250 psi and 500 psi, although this high pressure depends upon requirements and can be above that limit. The booster pump output is generally 30 to 160 gallons per minute, again depending on demands. On its way through the outlet lines the water will flow through check valve 62, and it will also travel toward check valve 40. It will hold check valve 40 closed as a result of the pressure differential and the direction of flow.

Figure 2:
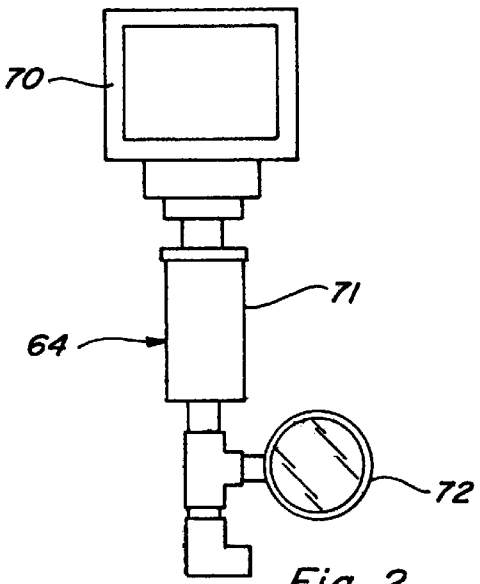
FIG. 2 is an enlarged view of a pressure controller mounted on the booster pump of FIG. 1.
Figure 3:
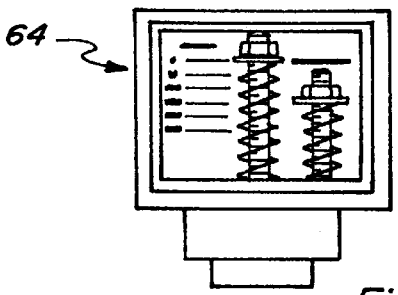
FIG. 3 is an enlarged cutaway view showing the pressure switch of FIG. 2 in greater detail.

Among the advantages of this invention are means for maintaining both a constant flow rate and a constant pressure. Bypass relief valve 42 is used to set the operating pressure of the booster pump. It allows water to bypass back to the pump chamber, 21, to maintain the operating pressure in the desired range. The pressure switch 64 controls the turning on and turning off of the booster pump. As seen in FIG. 2 this switch consists of a switch portion 70, an electronic controller 71, and a gage 72. The pressure switch controls the turning on and turning off of the booster pump. If the pressure falls below the operating pressure, switch 64 will shut down the pump. The range is set at a point (FIG. 3) when the pump is to come on, and the operating pressure is set by the bypass pressure relief valve. As an example if the operating pressure is set at 250 psi by the relief valve 42, and the pressure switch 64 is set at 150 (from the range in FIG. 3), these will be the operating conditions. If the discharge line pressure drops to 150 psi the turbopump will start and continue to run until electronic controller 71 sees no flow for ten seconds. The deadband adjustment is normally set to be 0 psi.

It has been pointed out that in addition to starting the booster pump when it is activated, flow switch 26 will keep the booster pump operating as long as there is fluid movement across the paddles of the flow switch. To maintain desired flow it will also keep the booster pump operating after it has been started by the pressure switch.

Figure 4:
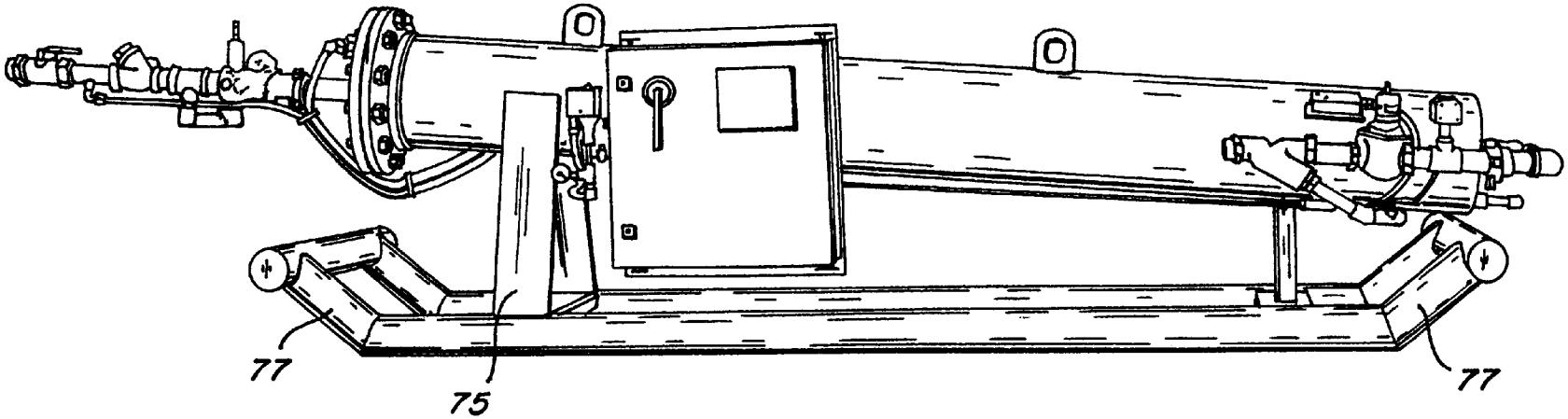
FIG. 4 is an elevation showing the booster pump of the invention and a preferred supporting framework.

It will be understood that booster pump 2 will be supported, as is well known, by a trailer or some other framework. FIG. 4 illustrates a preferred supporting structure 75 which is in the form of skids 77 rendering the booster pump portable for use in mines and on golf courses. We are not aware of any such portable high pressure pumps.

Figure 5:
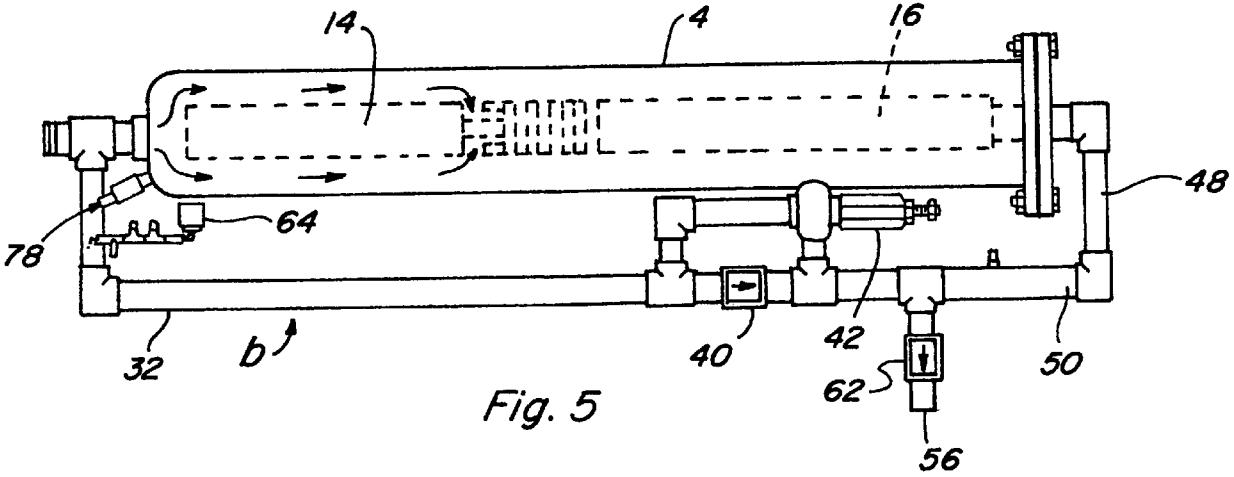
FIG. 5 is a diagrammatic representation of a second embodiment of a booster pump of the invention.

In FIG. 5 a different embodiment of a booster pump is illustrated. This high pressure pump includes cylinder 4, motor 14, bypass b, and outlet flow pipes 48 and 50, along with check valve 62 and outlet port 56. However, in this embodiment the booster pump is operated by the pressure switch components shown in FIG. 6 and incorporated in the bypass b. In addition, in the embodiment of FIG. 5 a bypass relief valve 78 is installed on the rear of the pump. This pressure relief valve will relieve the pressure generated by incoming water if it exceeds a predefined setting. Bypass pressure relief valve 42, again, is utilized to set the operating pressure of the booster pump, and it allows the water to bypass back to the pump chamber, 21, to maintain the required operating pressure range.

Figure 6:
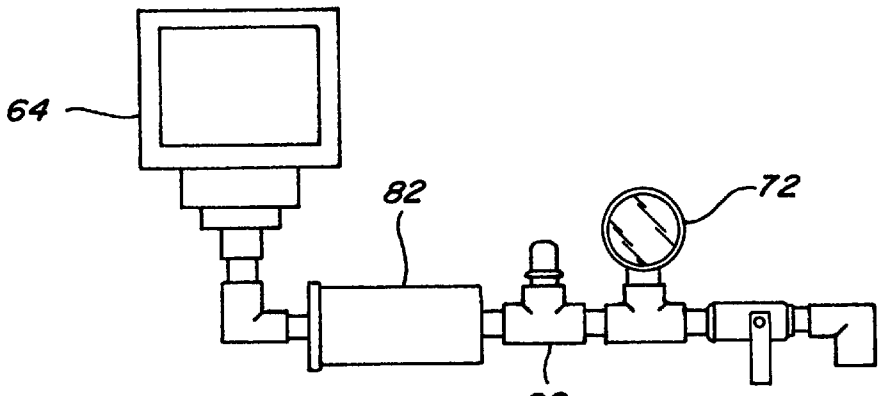
FIG. 6 diagrammatically illustrates the pressure control means mounted on the pump of FIG. 5.

The pressure switch components are illustrated in FIG. 6, and it will be noted that they are in the bypass circuit rather than in the outlet as shown and described in conjunction with FIG. 1. In FIG. 6 besides pressure switch 64 and gage 72 a pressure transducer 80 and an electronic controller 82 are shown. The pressure transducer 80 converts pounds per square inch in the discharge line to electrical current (4–20 milliamps). This signal is connected electrically to the pump controller and it conveys the system pressure to the electronic controller. The booster pump drive is programmed to look for 125 psi in its electrical equivalent the drive microprocessor is programmed to produce the desired result. The programming is well within the skill of the art. However an outline includes the following:

0. Check all fault conditions
1. Start pump motor. If flow is not called for pump shuts down in 10 sec. Start pump manually, with flow switch or pressure switch
2. Flow switch(SW)—cycle limit, pressure SW, SW disable
3. Start motor
4. Scan
5. Flow SW timer
6. Pressure SW Disable Limit
7. Pressure SW timer
8. Pressure SW Auto Scan
9. Auto SW position
10. Barrel pressure SW
11. Barrel pressure SW timer
12. Barrel pressure SW restart
13. Water temp SW

14. Flow SW

15. Overload relay

16. Low inlet water shutdown

17. Motor restart

18. Manual position BTU Count Up Counter Preset Accum

19. Manual position RTO Retentive timer Timer, Time base Preset Accum

20., 21., 22., RES

23. Barrel pressure SW

24. —end Pump Restarts

It is to be appreciated that an extremely transportable and reliable booster pump is provided by this invention. Most pumps for golf courses and mines must be located within 500 feet of the outlet or actual coal cutting. The booster pump herein can be located over a mile away from where the coal is being cut, resulting in a great labor and cost savings for the user. Further the booster pump of the invention is an excellent emulsion pump which can be mounted on a monorail for transferring emulsion fluid from an underground mine longwall face to the main pumping station.

In the light of the teachings of this invention other such ramifications and variations will occur to those skilled in the art. Thus whereas a cylinder, also termed a barrel, is preferred the vessel surrounding the motor-turbo combination, can be variously shaped. The barrel can take any desired form from a sphere to a cube. Moveover the main frame or cabinet can be in the form of a stand, a skid, a cart or any other preferred form. As another variation, to protect the motor and pump, a barrel temperature switch can be used to shut down the pump if the fluid inside the pump chamber exceeds the pre-set level. Similarly, a cabinet temperature switch can be used to shut down the pump if the cabinet (frame) temperature exceeds a pre-set level.

Figure 7:
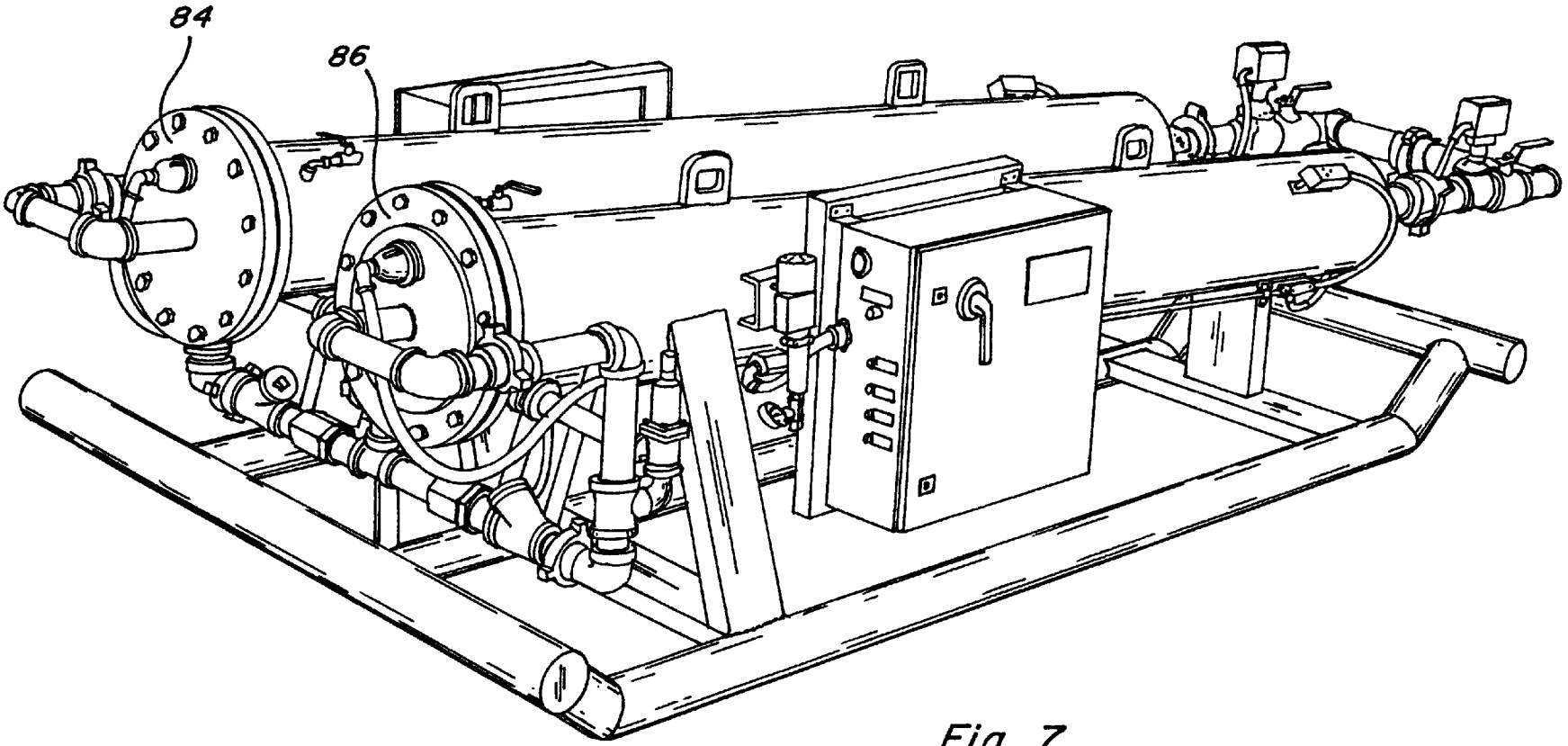
FIG. 7 illustrates a third embodiment of the invention.

An especially desirable embodiment of the invention is shown in FIG. 7. Multiple, preferably two booster pumps such as 84 and 86, can be connected in parallel or in series to accomplish a particular result. The pump assembly shown in FIG. 7 is a pump system for golf courses. The inlet pipe is coupled to the pump by a flanged bolt-together coupling. From there it is joined to a T-joint in order to enter the inlet sides of both booster pumps 75 and 77. By way of example, pump 75 can have a 625 gallons per minute output, and pump 77 can have a 375 gallons per minute output. When both booster pumps are operating at full speed there will be a combined total output of 1000 gallons per minute. The electronic controller will include two variable speed frequency drive inverters. One will be a 60 hp drive and the other will be a 30 hp drive. A variable speed drive is used to vary the speed of an AC motor. It will run the pump at any sped between 30 cycles and 80 cycles per second. The normal running revolutions per minute for the motor will be 3450 rpm at 60 cycles, and will increase or decrease depending on where it is programmed to operate. With the pressure transducer converting pounds per square inch in the discharge to electric current as previously described, a 4 to 20 ma signal will be connected electrically to both booster pump controllers. By programming both the internal microprocessors of both drives a constant pressure will be maintained. The effective twin longwall water booster pump is similar to the golf course application except that variable speed drives are not employed. These modifications and such others occurring to those in the field are deemed to be within the scope of this invention.

What is claimed is:

1. A booster water pump for increasing a source water pressure to a high water pressure for industrial use, the booster water pump comprising:

an elongated tubular hollow cylinder having both ends closed, a cylinder inlet port is located in one end, and a flange is located in an opposite end with a cylinder outlet port disposed therein wherein the hollow cylinder is capable of being filled with the source water;

a submersible motor and hydroturbine pumping unit is arranged so that a plurality of turbine impellers are disposed adjacent the motor with a turbine outlet facing away from the motor, the submersible motor and hydroturbine pumping unit is configured for insertion in the hollow cylinder, and is disposed in the hollow cylinder having a water annular passageway disposed therearound between the hollow cylinder and the submersible motor and hydroturbine pumping unit, the turbine outlet is attached inside the hollow cylinder to the cylinder outlet port;

the booster water pump having:

a water inlet pipe is attached outside the hollow cylinder to the cylinder inlet port;

a water outlet pipe is attached outside the hollow cylinder to the cylinder outlet port;

a coupling means is disposed for connecting a source water line to the water inlet pipe;

an automatic bypass line having a first end is connected to and opens into the water inlet pipe and a second end is connected to and opens into the water outlet pipe;

the booster water pump further having a pressure control means comprising:

a bypass relief valve configured with an inlet communicating with the water outlet pipe and an outlet communicating with the automatic bypass line to maintain an operating pressure;

a flow switch is disposed in the water inlet pipe for starting the pump in response to the flow of source water through the water inlet pipe, the flow switch further operably maintains a predetermined flow rate through the water outlet pipe upon starting of the pump;

a pressure control switch, said flow switch in combination with a pressure switch is adapted to turn on the pump when discharge line pressure drops below the operating pressure, the pressure switch is disposed in one of: the bypass line and the outlet pipe downstream from the bypass relief valve; and, at least one check valve for separating the high water pressure from the lower pressure source water.

2. The booster water pump of claim 1, wherein a controller and a pressure switch are disposed in the outlet pipe.

3. The booster water pump of claim 1, wherein a controller and a pressure switch are disposed in the bypass line.

4. The booster water pump of claim 3, wherein a bypass relief valve is installed in the inlet end of the booster pump.

5. The booster water pump of claim 3, wherein the pressure switch is controlled by an electronic controller and a microprocessor.

6. The booster water pump of claim 1, wherein the booster water pump is supported on a framework consisting of skids.

7. The booster water pump of claim 1, wherein the booster pump includes two booster pumps in parallel.

8. The booster water pump of claim 1, wherein the booster pump includes two booster pumps in series.

* * * * *